US008626051B2

(12) United States Patent
Kasuga et al.

(10) Patent No.: US 8,626,051 B2
(45) Date of Patent: Jan. 7, 2014

(54) IMAGE FORMING APPARATUS WITH CONVEYING PORTIONS HAVING A LOOP DETECTOR WITH CONTACT PORTION FOR CONTACTING THE SHEET

(75) Inventors: Kuniaki Kasuga, Mishima (JP); Daizo Fukuzawa, Mishima (JP); Noriaki Sato, Suntou-gun (JP); Mahito Yoshioka, Numazu (JP); Munehito Kurata, Suntou-gun (JP); Tooru Imaizumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 463 days.

(21) Appl. No.: 12/958,771

(22) Filed: Dec. 2, 2010

(65) Prior Publication Data

US 2011/0150548 A1 Jun. 23, 2011

(30) Foreign Application Priority Data

Dec. 22, 2009 (JP) ..... 2009-290292

(51) Int. Cl.
*G03G 15/00* (2006.01)
*B65H 5/34* (2006.01)

(52) U.S. Cl.
USPC ..... 399/400; 399/68; 399/396; 399/397; 271/270

(58) Field of Classification Search
USPC ..... 399/397, 400, 396, 68, 16; 271/3.18, 271/265.01, 270
See application file for complete search history.

(56) References Cited

U.S. PATENT DOCUMENTS

| | | | | |
|---|---|---|---|---|
| 4,589,758 | A | 5/1986 | Kasama et al. | |
| 4,862,215 | A | 8/1989 | Nomura et al. | |
| 5,177,547 | A | 1/1993 | Kanemitsu et al. | |
| 5,669,039 | A | 9/1997 | Ohtsuka et al. | |
| 5,808,647 | A | 9/1998 | Kurata et al. | |
| 6,526,251 | B1 | 2/2003 | Otsuka et al. | |
| 8,131,203 | B2 * | 3/2012 | Kitan | 399/400 |
| 8,320,815 | B2 * | 11/2012 | Yano et al. | 399/392 |
| 2009/0162121 | A1 * | 6/2009 | Kitan | 399/400 |
| 2009/0180822 | A1 * | 7/2009 | Yano et al. | 399/388 |
| 2009/0202266 | A1 | 8/2009 | Kurata et al. | |

FOREIGN PATENT DOCUMENTS

| | | | |
|---|---|---|---|
| JP | 07-140740 | A | 6/1995 |
| JP | 7-234604 | | 9/1995 |
| JP | 2005010238 | A | 1/2005 |
| JP | 2009155007 | A | 7/2009 |
| JP | 5089371 | B2 | 9/2012 |

* cited by examiner

*Primary Examiner* — Judy Nguyen
*Assistant Examiner* — Justin Olamit
(74) *Attorney, Agent, or Firm* — Fitzpatrick, Cella, Harper & Scinto

(57) ABSTRACT

The present invention provides an image forming apparatus including an upstream conveying portion, a downstream conveying portion, and a loop detector, wherein the image forming apparatus further includes a driving portion which moves the contact portion to a projecting position where the sheet conveying path is in contact with a conveyed sheet and to a retracted position where the sheet conveying path is not in contact with the conveyed sheet, and a controlling portion which controls the driving portion such that the contact portion is moved from the projecting position to the retracted position before a tip end of a sheet which enters the sheet conveying path from the upstream conveying portion reaches the contact portion.

9 Claims, 8 Drawing Sheets

IMAGE FORMING APPARATUS WITH CONVEYING PORTIONS HAVING A LOOP DETECTOR WITH CONTACT PORTION FOR CONTACTING THE SHEET

BACKGROUND OF THE INVENTION

1. Field of the Invention

The present invention relates to an image forming apparatus using an electrophotographic system such as a copying machine and a printer.

2. Description of the Related Art

According to a conventional image forming apparatus, when a sheet is nipped by a nip portion of a fixing apparatus and a transfer apparatus and conveyed in this state, if the sheet is pulled from the fixing apparatus, deviation or rubbing of an image is generated in some cases. To prevent the deviation and rubbing of an image, there is a known image forming apparatus having a configuration that a sheet is looped and conveyed in this state upstream of the fixing apparatus. According to this image forming apparatus, passing timing of a sheet is detected using a sensor which is disposed on an intermediate portion of a conveying path, a rotation velocity of a roller of the fixing apparatus is variably controlled according to the detected timing, thereby generating a loop in the sheet at an upstream portion of the fixing apparatus.

However, it is difficult to constantly maintain a conveying velocity of a sheet due to factors such as variation in machining precision of parts constituting the apparatus and thermal expansion, and as a result, it is difficult to constantly maintain a loop amount of a sheet.

Hence, there is a known image forming apparatus having a device which detects a loop amount and maintains the loop amount within a predetermined range based on the detection (Japanese Patent Application Laid-open No. H7-234604). That is, the image forming apparatus body includes a sensor which detects an upper limit and a lower limit of the loop amount formed by a sheet, and control is performed such that when the upper limit of the loop amount is detected, a velocity of a driving portion of the fixing apparatus is increased, and when the lower limit of the loop amount is detected, the velocity of the driving portion of the fixing apparatus is reduced.

To detect the loop amount described in Japanese Patent Application Laid-open No. 7-234604, if a mechanical sensor is disposed between the transfer apparatus and the fixing apparatus and the sensor is brought into contact with a sheet, a problem concerning a conveying operation of the sheet is generated in some cases. When a sheet (thin paper sheet) having a basis weight of 60 g/m$^2$ or less is to be conveyed, since elasticity of the sheet is weak, there are problems that a tip end of the sheet (sheet tip end, hereinafter) collides against the mechanical sensor which is a loop detector and a conveying track is hindered, and a generation ratio of a paper jam and a wrinkle is increased. Especially in recent years, people are more environmentally aware, recycled paper is utilized of course, and since a using amount of pulp which is a raw material can be reduced, it is expected that a demand for thin paper sheets will increase more and more in the future.

The present invention provides an image forming apparatus in which a loop is formed in a sheet, but a sheet tip end does not collide against a mechanical sensor which detects a loop amount, appropriate loop control is performed without hindering a track when the sheet is conveyed, thereby suppressing generation of an image failure.

SUMMARY OF THE INVENTION

The present invention provides an image forming apparatus including an upstream conveying portion which conveys a sheet, a downstream conveying portion which is disposed downstream of the upstream conveying portion and which conveys the sheet, and a loop detector which brings a contact portion into contact with the sheet which is conveyed on a sheet conveying path between the upstream conveying portion and the downstream conveying portion, thereby detecting a loop of the sheet, wherein at least one of the upstream conveying portion and the downstream conveying portion is controlled based on a detection signal of the loop detector, and the sheet is conveyed while maintaining a loop amount within a predetermined range, and a driving portion which moves the contact portion to a projecting position where the sheet conveying path is in contact with a conveyed sheet and to a retracted position where the sheet conveying path is not in contact with the conveyed sheet, and a controlling portion which controls the driving portion such that the contact portion is moved from the projecting position to the retracted position before a tip end of a sheet which enters the sheet conveying path from the upstream conveying portion reaches the contact portion.

According to the present invention, the contact portion is moved to the retracted position before the sheet tip end reaches the contact portion, and then, it is possible that a tip end of a sheet which enters the sheet conveying path from the upstream conveying portion does not collide against the contact portion of the loop detector. Therefore, a generation ratio of a paper jam and a paper wrinkle can be reduced, and generation of image deviation and rubbing can largely be reduced.

Further features of the present invention will become apparent from the following description of exemplary embodiments with reference to the attached drawings.

DESCRIPTION OF THE EMBODIMENTS

First Embodiment

Figure 1:
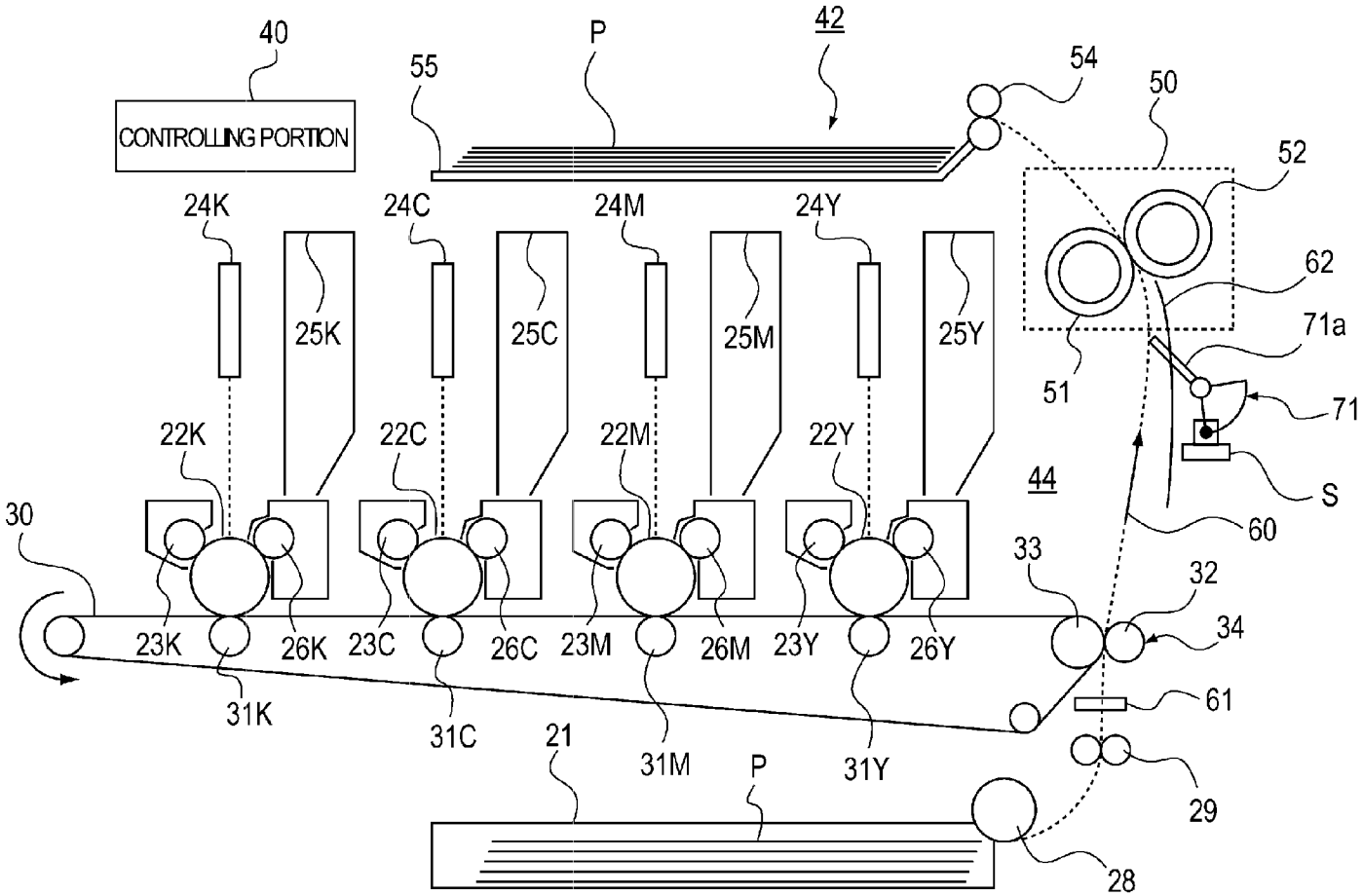
FIG. 1 is a schematic sectional view of a mechanism portion of an image forming apparatus according to the present invention.

A first embodiment of the present invention will be described with reference to FIGS. 1 to 6. FIG. 1 illustrates one example of a color image forming apparatus of an electrophotographic system. First, an operation of the color image forming apparatus 42 of the electrophotographic system will be described using FIG. 1.

As illustrated in FIG. 1, the color image forming apparatus 42 includes a sheet feeding portion 21, photosensitive drums 22Y, 22M, 22C, and 22K, chargers 23Y, 23M, 23C, and 23K, toner cartridges 25Y, 25M, 25C, and 25K which are arranged in every station in a development color-coded manner. The color image forming apparatus 42 also includes development devices 26Y, 26M, 26C, and 26K, an intermediate transfer belt 30, primary transfer rollers 31Y, 31M, 31C, and 31K, a secondary transfer roller 32, a secondary transfer counter roller 33 and a fixing unit 50. The color image forming apparatus 42 forms an electrostatic latent image by exposure controlled by a controlling portion 40 based on an image signal, develops the electrostatic latent image to form a monotone toner image, and superposes the monotone toner images to form a multicolor toner image. The color image forming apparatus 42 further transfers the multicolor toner image to a sheet P, and fixes the multicolor toner image on the sheet P. Each of the photosensitive drums 22Y, 22M, 22C, and 22K is formed by applying an organic light-transmission layer on an outer periphery of an aluminum cylinder, a driving force of a drive motor (not illustrated) is transmitted and the photosensitive drum rotates in the clockwise direction.

Chargers 23Y to 23K electrify the photosensitive drums 22Y to 22K of yellow (Y), magenta (M), cyan (C) and black (K) in every station. Exposure of the photosensitive drums 22Y, 22M, 22C, and 22K are arranged such that they are sent from scanner portions 24Y, 24M, 24C, and 24K, surfaces of the photosensitive drums 22Y, 22M, 22C, and 22K are selectively exposed, thereby forming an electrostatic latent image. To visualize the electrostatic latent image, the development devices 26Y, 26M, 26C, and 26K develop yellow (Y), magenta (M), cyan (C) and black (K) in every station. The scanner portions 24Y to 24K, the photosensitive drums 22Y to 22K and the development devices 26Y to 26K constitute an image forming portion 44.

A resin intermediate transfer belt 30 is in contact with the photosensitive drums 22Y, 22M, 22C, and 22K, and is rotated in the counterclockwise direction by a drive motor (not illustrated). The intermediate transfer belt 30 rotates as the photosensitive drums 22Y, 22M, 22C, and 22K rotate according to an image forming operation, bias is applied to the primary transfer rollers 31Y, 31M, 31C, and 31K, thereby transferring monotone toner images sequentially. Transfer remaining toner which remains on the photosensitive drum is collected by a photosensitive drum cleaning portion (not illustrated) provided on each photosensitive member.

A sheet P which is previously prepared in a sheet feeding portion 21 is conveyed by a sheet feeding roller 28 and a registration roller 29 and then, a secondary transfer roller 32 disposed such that it abuts against the intermediate transfer belt 30 nips and conveys the sheet P. A registration sensor 61 which detects a position of the tip end of a sheet sent out from the registration roller 29 is disposed between the secondary transfer roller 32 and the registration roller 29.

By applying bias to the secondary transfer roller 32, a multicolor toner image on the intermediate transfer belt 30 is transferred to a sheet P. The sheet P on which the multicolor toner image is formed is conveyed to a fixing unit 50 which is a fixing apparatus along the fixing inlet guide 62, and the image is fixed. The intermediate transfer belt 30 is supported by the secondary transfer counter roller 33, and is rotated by drive-input to the secondary transfer counter roller 33. The secondary transfer roller 32 and the secondary transfer counter roller 33 constitute a transfer apparatus 34. The sheet feeding portion 21, the sheet feeding roller 28 and the registration roller constitute a sheet feeding apparatus which feeds sheets to the transfer apparatus 34.

The fixing unit 50 melts and fixes a transferred multicolor toner image while nipping and conveying a sheet P. The fixing unit 50 of this embodiment is inexpensive and has a small thermal capacity, and is a film fixing unit having short warming up time. The fixing unit 50 includes a fixing sleeve 51 which heats a sheet P, and a pressure roller 52 which presses a sheet against the fixing sleeve 51.

The fixing sleeve 51 is a cylindrical (endless belt-shaped) member formed by providing a belt-shaped member with a resilient layer. More specifically, SUS is used as material thereof, a silicon rubber layer (resilient layer) having a thickness of about 300 μm is formed on a cylindrical endless belt (belt base material) having a thickness of 30 μm, and a PFA resin tube (outermost surface layer) having a thickness of 30 μm is coated thereon. The pressure roller 52 is formed in such a manner that a silicon rubber layer having a thickness of about 3 mm is formed on a stainless core metal by mold injection, and this is coated with a PFA resin tube having a thickness of about 40 μm.

The fixing unit 50 is driven by rotating the pressure roller 52, and the fixing sleeve 51 is worn and driven by a surface of the pressure roller 52. The pressure roller 52 is driven by rotating the core metal, but since the outer diameter of the pressure roller 52 is varied by manufacturing tolerances and thermal expansion of rubber, the surface velocity cannot maintain constantly even if the pressure roller 52 is rotated at a constant angular velocity. Further, the surface velocity of the fixing sleeve 51 which is driven by the pressure roller 52 is also varied by coefficients of friction of both the members, and surface properties and a thickness of a sheet to be used. For this reason, the conveying velocity of a sheet at the fixing portion (fixing unit 50) has an extremely large variation element, and it is very difficult to conform this to the paper conveying velocity of the transfer portion (transfer apparatus 34). A sheet loop generated by a difference in a paper conveying velocity between the transfer portion and the fixing portion and color deviation generated by a pulling action of a sheet become a big problem in the in-line color image forming apparatus 42.

Therefore, in the color image forming apparatus 42 of the electrophotographic system, a mechanical sheet detector called a loop sensor is provided between the transfer portion and the fixing portion, and loop control is performed by controlling a velocity of the fixing unit 50 based on a signal detected by this detector.

Next, in the color image forming apparatus 42 of this embodiment, the loop control of a sheet P which is performed between the transfer apparatus 34 and the fixing unit 50 will be described with reference to FIG. 2.

Figure 2:
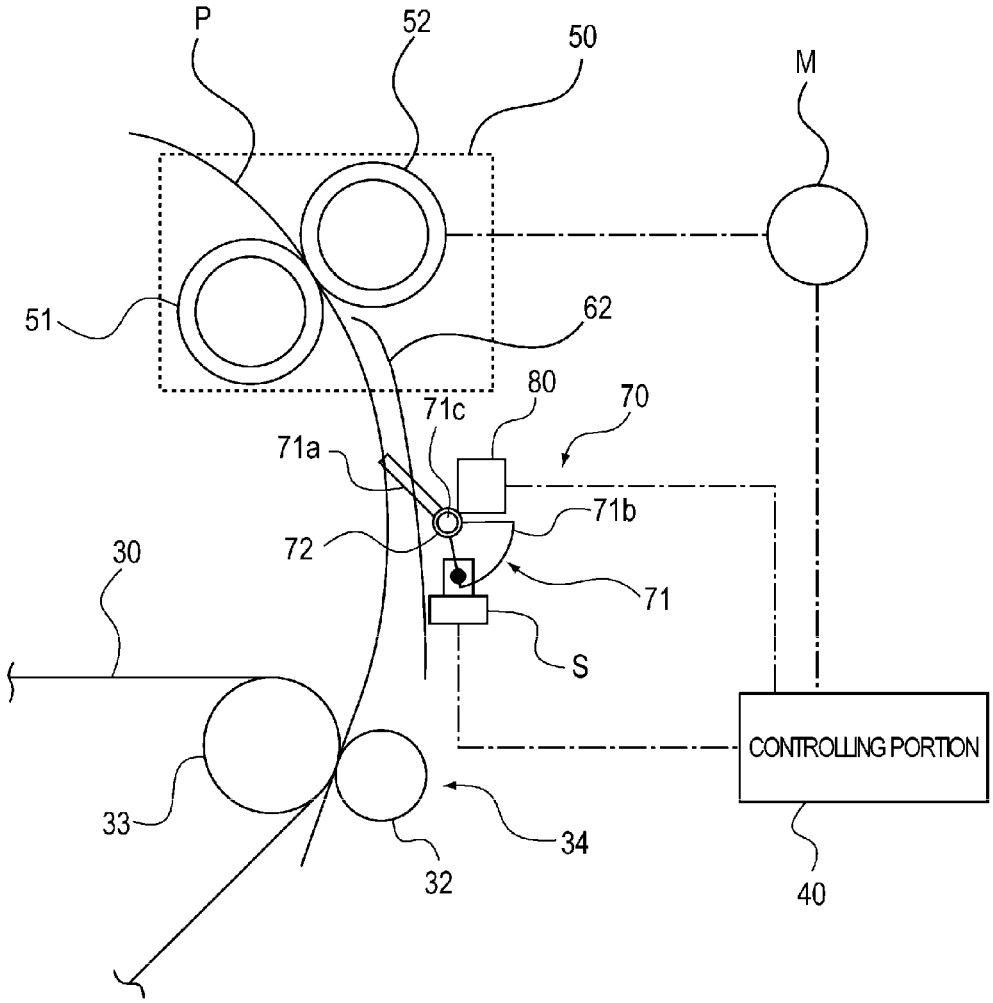
FIG. 2 is a schematic sectional view illustrating a state between a transfer portion and a fixing portion in a first embodiment.

As illustrated in FIG. 2, the color image forming apparatus 42 includes a contact type loop detector 70 which detects a magnitude of a loop of a sheet P formed between the transfer apparatus 34 and the fixing unit 50, and a fixing drive motor M as a fixing driving portion which rotates and drives the pressure roller 52. The loop detector 70 brings a contact portion 71*a* into contact with a sheet P which is conveyed on the sheet conveying path 60 between the transfer apparatus 34 and the fixing unit 50, thereby detecting the loop of the sheet P. The fixing drive motor M is a stepping motor, and the fixing drive motor M can switch the conveying velocity of a sheet P by the pressure roller 52 and the fixing sleeve 51 which follows the pressure roller 52 between a plurality of slow velocities and a plurality of fast velocities with respect to the secondary transfer roller 32 of the transfer apparatus 34.

The color image forming apparatus 42 includes the controlling portion 40. The controlling portion 40 controls projection/retraction of the contact portion 71*a* in a loop detection flag 71 from and into the sheet conveying path 60. That is, the controlling portion 40 of this embodiment controls a solenoid 80 such that the contact portion 71*a* is moved from a projection position (see FIG. 4A) to a retracted position (see FIG. 4B) before a tip end of a sheet P which enters the sheet conveying path 60 from the transfer apparatus 34 reaches the contact portion 71*a*. The controlling portion 40 performs control such that it switches the sheet conveying velocity of the fixing unit 50 based on a detection signal of the loop detector 70, and the loop amount of the sheet P is maintained within a predetermined range.

As described above, the color image forming apparatus 42 includes the image forming portion 44, and the intermediate transfer belt 30 which is an image bearing member bearing a toner image formed by the image forming portion 44. In this embodiment, the transfer apparatus 34 constitutes an upstream conveying portion which conveys a sheet P while transferring a toner image born by the intermediate transfer belt 30, i.e., which conveys a sheet P while nipping the sheet P. The fixing unit 50 constitutes a downstream conveying portion which conveys a sheet P while fixing a toner image transferred to the sheet P by the transfer apparatus 34, i.e., which conveys a sheet P while nipping the sheet P.

The solenoid 80 of the loop detector 70, a photo sensor S and the fixing drive motor M are connected to the controlling portion 40. The controlling portion 40 controls a sheet conveying velocity based on a detection signal of the loop detector 70, and controls a rotation velocity of the fixing drive motor M such that a loop amount of a sheet P is maintained within a predetermined range and the sheet P is conveyed. Not limited to the above description, the controlling portion 40 may control a driving state of the secondary transfer roller 32 of the transfer apparatus 34 based on a detection signal of the loop detector 70, thereby controlling a sheet conveying velocity, and a loop amount of a sheet P is maintained within a predetermined range and the sheet P is conveyed. In this case also, the same effect can be obtained.

The loop detector 70 which is a loop sensor will be described in detail with reference to FIGS. 2 to 4A and 4B. The loop detector 70 has a loop detection flag 71 which is provided at its tip end with a contact portion 71*a* and at its rear end with a flag portion 71*b*, a photo sensor S which outputs a detection signal according to variation of the flag portion 71*b* with respect to a light emitting/receiving portion 45, and the solenoid 80. The loop detection flag (loop sensor) 71 includes a torsion spring 72 as a biasing member which biases the contact portion 71*a* toward the sheet conveying path 60.

The photo sensor S detects a motion of the loop detection flag 71 which is operated by contact with a sheet between the transfer apparatus 34 and the fixing unit 50, and detects a contact state with respect to a sheet according to variation of the flag portion 71*b* when the loop detection flag 71 abuts against the sheet and rotates. The solenoid 80 constitutes a driving portion which moves the contact portion 71*a* of the loop detection flag 71 between a projecting position (see FIG. 4A) where the sheet conveying path 60 is brought into contact with a conveyed sheet P and a retracted position (see FIG. 4B) where the sheet conveying path 60 is not in contact with the sheet P. The torsion spring 72 moves and biases the contact portion 71*a* of the loop detection flag 71 toward the sheet conveying path 60, one end of the torsion spring 72 is supported by a back surface of the contact portion 71*a*, and the other end of the torsion spring 72 is fixed to and supported by the image forming apparatus body.

Figure 3:
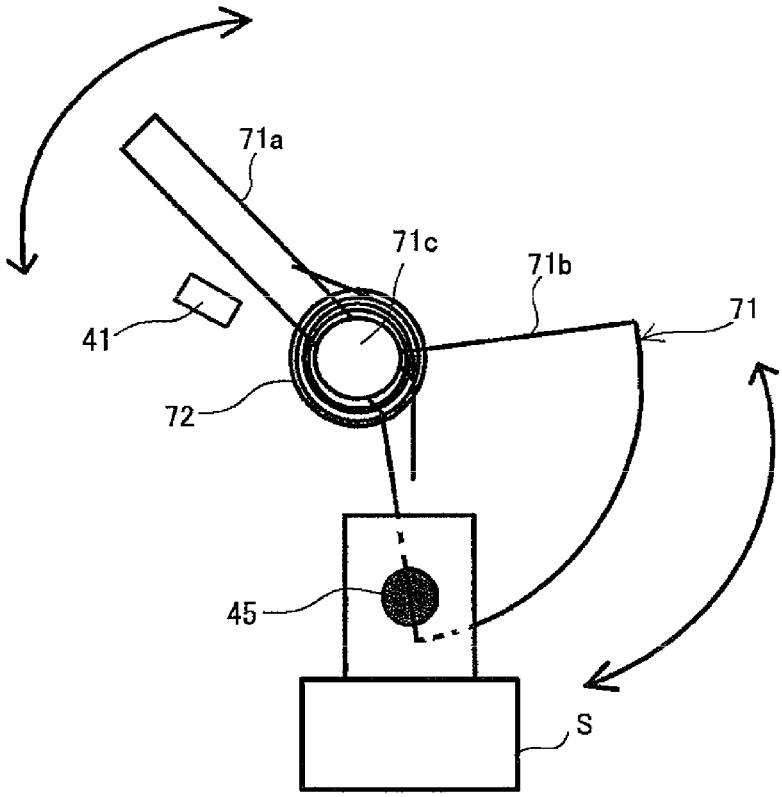
FIG. 3 is a schematic sectional view of a loop sensor in the first embodiment.

The loop detection flag 71 turns in the clockwise direction and the counterclockwise direction in FIG. 3 around, as a fulcrum, a shaft portion 71*c* which is rotatably supported on the of the image forming apparatus body, and the contact portion 71*a* and the flag portion 71*b* are opposed to each other with the shaft portion 71*c* interposed therebetween. A turning force applying portion 71*d* is formed on the flag portion 71*b* such that the turning force applying portion 71*d* projects from an arc upper portion toward an outer diameter direction. The loop detection flag 71 is restricted by a detent member 41 supported on the of the image forming apparatus body so that the contact portion 71*a* does not rotate beyond a home position illustrated in FIG. 4A.

The solenoid 80 has a body portion 80*b* fixed to and supported by a position on the of the image forming apparatus body where an extended plunger 80*a* can push the turning force applying portion 71*d*. The contact portion 71*a* projects into a projecting position where a sheet P which is conveyed on the sheet conveying path 60 between the transfer apparatus 34 and the fixing unit 50 is brought into contact with the sheet conveying path 60, the flag portion 71*b* is brought into contact with the sheet P and is moved, thereby allowing the photo sensor S to output a detection signal. In a state where the plunger 80*a* retracts into the body portion 80*b*, the contact portion 71*a* turns toward the fixing inlet guide 62 which defines the sheet conveying path 60 according to a spring force of the torsion spring 72 until the contact portion 71*a* is restricted by the detent member 41, and the contact portion 71*a* comes to the projecting position (see FIG. 4A). At that time, while the contact portion 71*a* is pushed by a back surface of a sheet P, the flag portion 71*b* which turns around the shaft portion 71*c* as a fulcrum shields light of the light emitting/receiving portion 45 of the photo sensor S, and the photo sensor S outputs an ON detection signal.

If the plunger 80*a* projects from the body portion 80*b*, the contact portion 71*a* turns in a direction separating from the fixing inlet guide 62 against a spring force of the torsion spring 72, and comes to the retracted position (see FIG. 48). By turning the contact portion 71*a* in the direction of arrows in FIG. 3 according to a loop amount of a sheet P, the loop detection flag 71 switches the light emitting/receiving portion 45 of the photo sensor S between a light transmission state (OFF) and a light shielding state (ON), thereby outputting a corresponding detection signal.

The controlling portion 40 receives a detection signal of the photo sensor S, and while the contact portion 71*a* pushes a sheet P, the controlling portion 40 determines that the conveying velocity of the transfer apparatus 34 is faster (pushing) than the fixing unit 50. At that time, the controlling portion 40 controls such that a target velocity of the fixing drive motor M is changed, a driving velocity of the pressure roller 52 is slightly increased, thereby eliminating a loop. On the contrary, if the conveying velocity of the fixing unit 50 is too fast, a sheet P starts to be pulled, and the contact portion 71*a* is not in contact with the sheet P. At that time, the controlling portion 40 determines that the fixing unit 50 starts to pull the sheet P, and controls such that the driving velocity of the pressure roller 52 is slightly lowered.

By carrying out such a routine sequentially, a sheet P is conveyed while keeping the loop amount within the predetermined range, and an excessive pulled state of a loop of the sheet P is eliminated. However, when such a system is used, it is necessary that a sheet P pushes up the contact portion 71*a* and operates at the instant when the sheet enters the fixing inlet guide 62. Therefore, there is an adverse possibility that a sheet tip end collides against the contact portion 71*a* and the conveying operation is hindered. For example, when a thin paper sheet having a basis weight of 60 g/m2 is conveyed, since elasticity of the sheet is weak, the sheet tip end collides against the contact portion 71*a*, a conveying track is hindered, and a generation ratio of a paper jam and a wrinkle is increased.

To solve this problem, in this embodiment, collision between the sheet tip end and the contact portion 71*a* is avoided between the transfer apparatus 34 and the fixing unit 50 so that conveyance of a sheet is not hindered, a loop is appropriately controlled, and generation of image failure is suppressed.

Figure 4A:
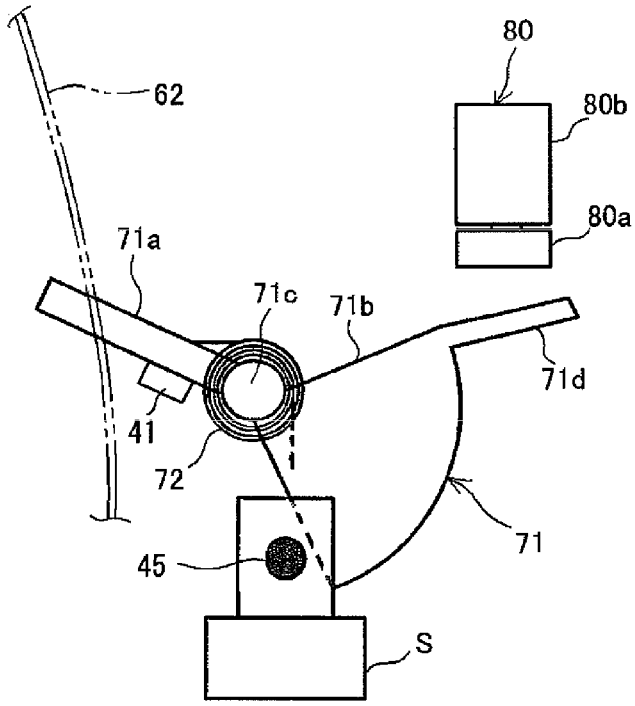
FIGS. 4A and 4B are schematic sectional views illustrating variation of a contact portion of the loop sensor in the first embodiment.
Figure 4B:
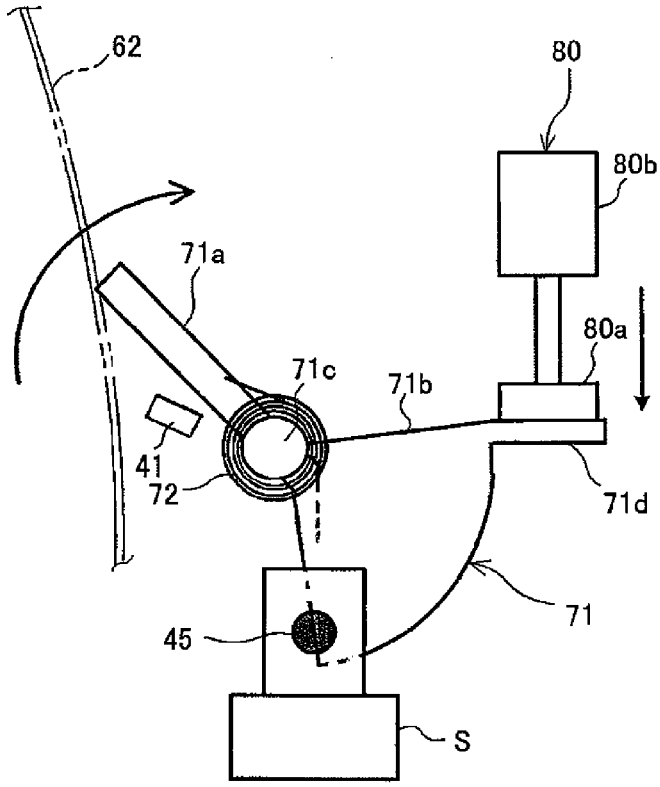

More specifically, before a sheet tip end enters a position of the loop detection flag (loop sensor) 71, the turning force applying portion 71*d* is pushed in by the plunger 80*a*, thereby turning the loop detection flag 71. According to this configuration, the contact portion 71*a* is retracted from the sheet conveying path 60 as illustrated in FIG. 4B. Then, after the sheet tip end passes through the position of the loop detection flag 71, the plunger 80*a* of the solenoid 80 is moved backward, and the contact portion 71*a* is pushed against a back surface of the sheet. After that, detection of a loop amount and loop control are started by the above-described method.

Figure 5:
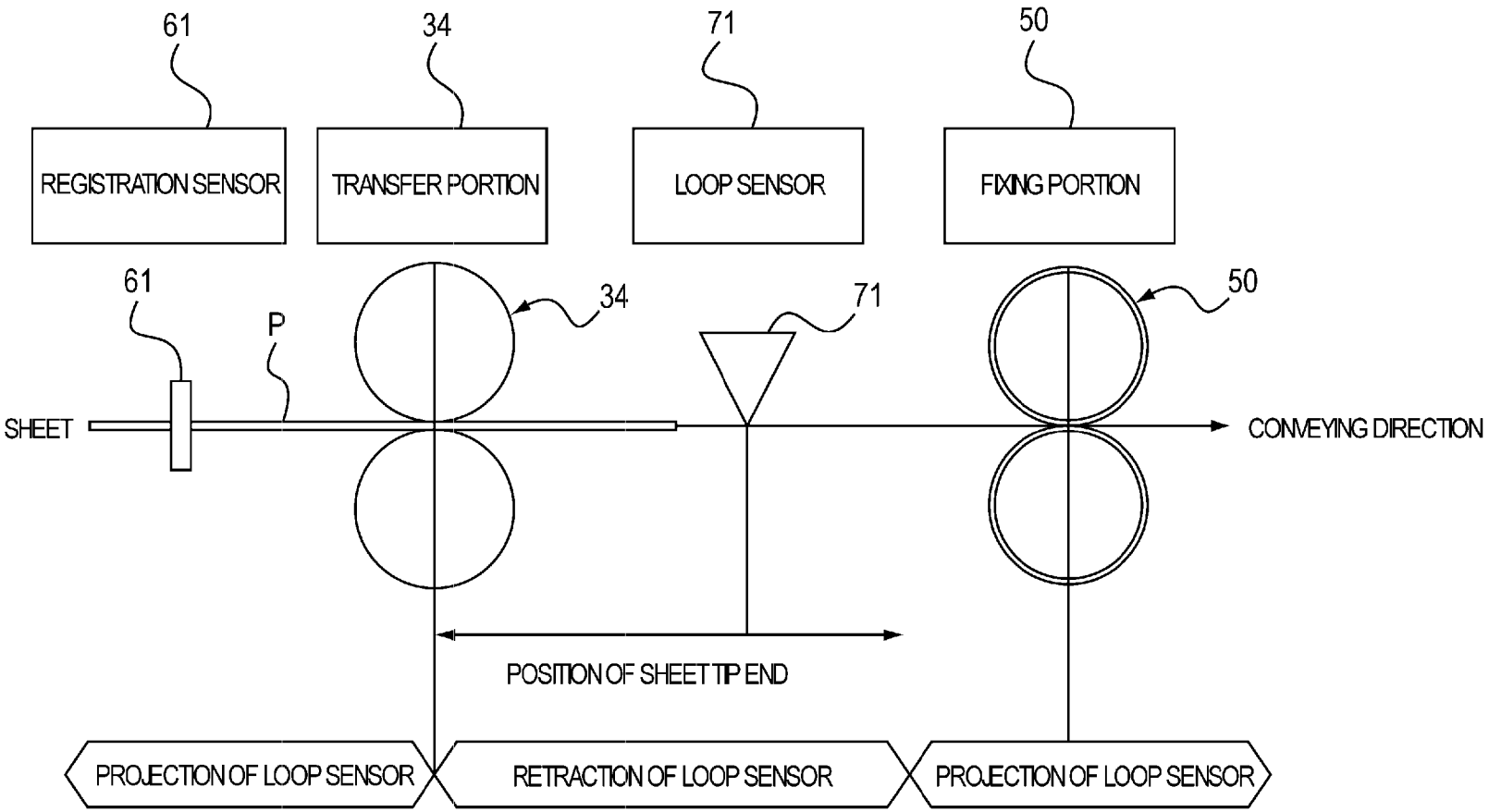
FIG. 5 is a schematic diagram illustrating projecting/retracting timing of the loop sensor in the first embodiment.

FIG. 5 illustrates timing at which the contact portion 71*a* is retracted from the sheet conveying path 60. FIG. 5 illustrates that when a sheet tip end position is in a range shown with arrows, the contact portion 71*a* is retracted from the sheet conveying path 60. In this embodiment, when the position of the sheet tip end reaches the transfer apparatus 34, the contact portion 71*a* is retracted from the sheet conveying path 60. When the sheet tip end position passes through the position of the loop detection flag 71 (loop sensor position), the contact portion 71*a* is projected into the sheet conveying path 60 and comes into contact with the sheet P.

The timing when the sheet tip end reaches the position of the transfer apparatus (transfer portion) and the position of the loop detection flag (loop sensor) 71 is detected by the registration sensor 61 disposed between the registration roller 29 and the transfer apparatus 34. That is, time elapsed until the sheet tip end reaches the respective positions after the sheet tip end passes through the position of the registration sensor is found from a distance from the registration sensor 61 to the transfer apparatus 34 and the loop detection flag 71, and from the sheet conveying velocity which is set in the color image forming apparatus 42. Therefore, after the registration sensor 61 detects the sheet tip end, if the solenoid 80 is operated when given time is elapsed, a desired operation can be carried out.

In this embodiment, the contact portion 71*a* retracted from the sheet conveying path 60 is made to project into the sheet conveying path 60 before the sheet tip end enters the fixing unit 50, and comes into contact with the back surface of the sheet. That is, when a sheet which enters the sheet conveying path 60 passes through the contact portion 71*a* at the retracted position under control of the solenoid 80, if there is no subsequent sheet, the controlling portion 40 moves the contact portion to the projecting position before the tip end of the sheet which has passed through the contact portion reaches the fixing unit 50. According to this configuration, the "attitude" of the sheet can previously be detected before the sheet P enters the fixing unit 50. That is, before the sheet tip end enters the fixing unit 50, the contact portion 71*a* comes into contact with the sheet, thereby detecting the attitude of the sheet before it enters the fixing unit 50, and appropriate loop control can be performed immediately after the sheet enters according to the attitude. According to this, slack or tension of the sheet can be avoided.

Figure 6:
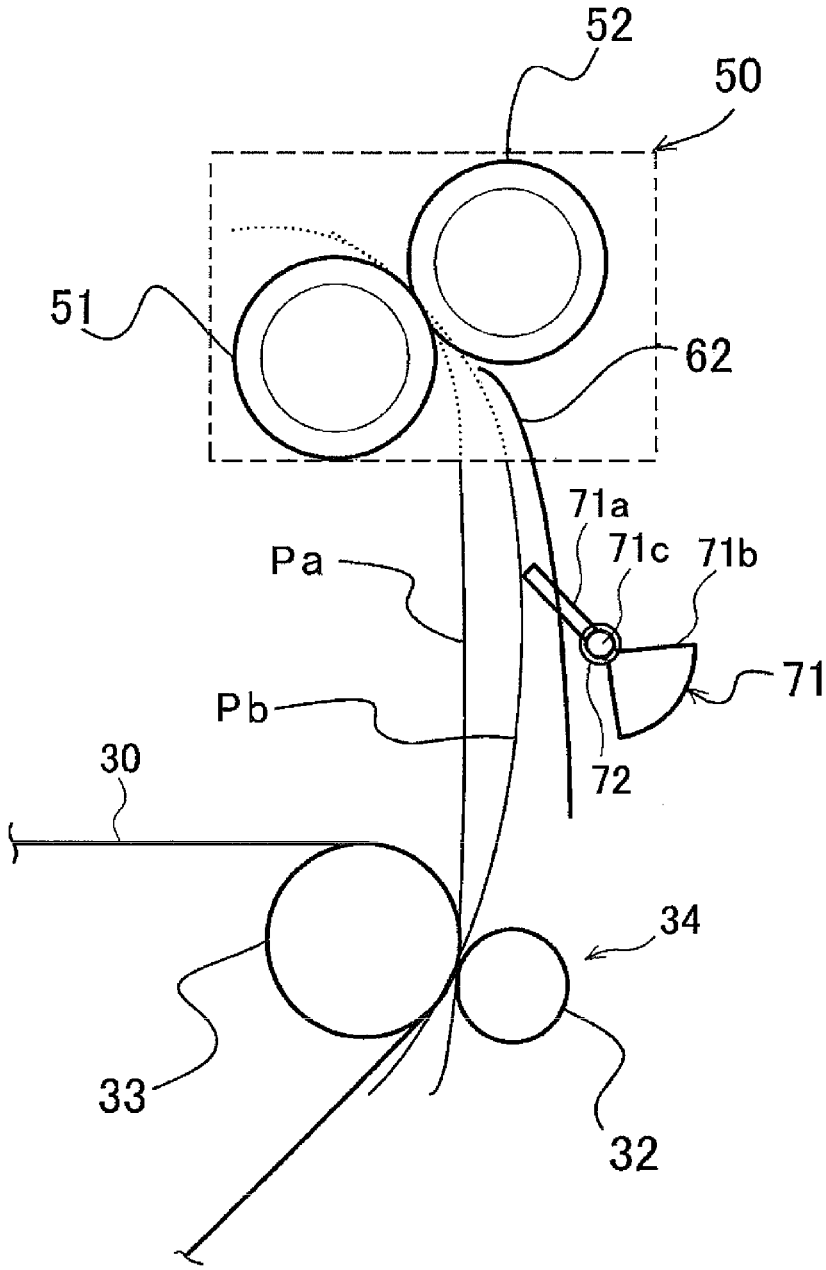
FIG. 6 is a schematic diagram illustrating an attitude when a sheet enters in the first embodiment.

FIG. 6 illustrates this state. That is, the entering attitude of a sheet P is restricted by the fixing inlet guide 62 in some degree, but the sheet conveying path 60 has flexibility, and a track becomes straight like a sheet Pa in some cases, or the track swells and sags like a sheet Pb in some cases. If a sheet P enters the fixing unit 50 with such attitude, the sheet P is slightly pulled or slightly sags due to a velocity difference between the fixing unit 50 and the transfer apparatus 34 until the appropriate loop control starts immediately after the sheet P enters the fixing unit 50.

However, if the attitude of the sheet P when it enters the fixing unit 50 is previously known, it is possible to prevent this phenomenon. For example, the photo sensor S is in the light transmission state (OFF) when the contact portion 71*a* is made to project into the sheet conveying path 60, the controlling portion 40 determines that the track is straight like the sheet Pa. The rotation velocity of the pressure roller 52 is previously lowered to prevent that the fixing unit 50 excessively pulls the sheet when the sheet enters. On the contrary, if the photo sensor S is in the light shielding state (ON), the controlling portion 40 determines that the track slightly sags like the sheet Pb, the rotation velocity of the pressure roller 52 is previously increased, and controls such that the sag of the sheet is eliminated after the sheet enters.

A result of check of a harmful influence of an image when this embodiment is used and when a comparative example is used is shown below. In the comparative example, the contact portion 71*a* is not retracted when a sheet enters. Sheets of paper having three kinds of basis weights are prepared, 1000 sheets of each kind are fed, and generation ratios of a paper wrinkle and paper jam generated near the loop detection flag 71 are compared. Table 1 shows generation ratios of a paper wrinkle and paper jam at the position of the loop detection flag 71.

TABLE 1

| | Sheet basis weight (g/m2) | | |
|---|---|---|---|
| | 75 | 60 | 52 |
| Comparative example | ○ | Δ | x |
| First embodiment | ○ | ○ | ○ |

○: Not generated
Δ: Generation ratio is less than 1%
x: Generation ratio is 1% or more From the result shown in Table 1, in the comparative example, as the basis weight of sheets were reduced in the order of 75 g/m2, 60 g/m2 and 52 g/m2, and the generation ratio of a paper wrinkle and paper jam at the position of the loop detection flag 71 was increased. In the embodiment, however, sheets of paper having a small basis weight (basis weight of 60 g/m2 or less), it can be found that generation of a paper wrinkle and paper jam can be prevented.

In this embodiment, the registration sensor 61 detects the timing of retracting the loop detection flag 71 from the sheet conveying path 60. However, if the timing when a position of the sheet tip end reaches a position of the loop detection flag 71 can be detected, it is also possible to use a sensor other than the registration sensor 61.

The loop detector 70 provided on the sheet conveying path is utilized and in addition to this, transfer current flowing through the secondary transfer roller 32 is monitored when a sheet enters the secondary transfer portion (transfer apparatus 34). It is possible to perform control such that the sheet reaching timing is detected based on variation in the transfer current, and the loop detection flag 71 is retracted using this timing as a trigger.

Figure 7:
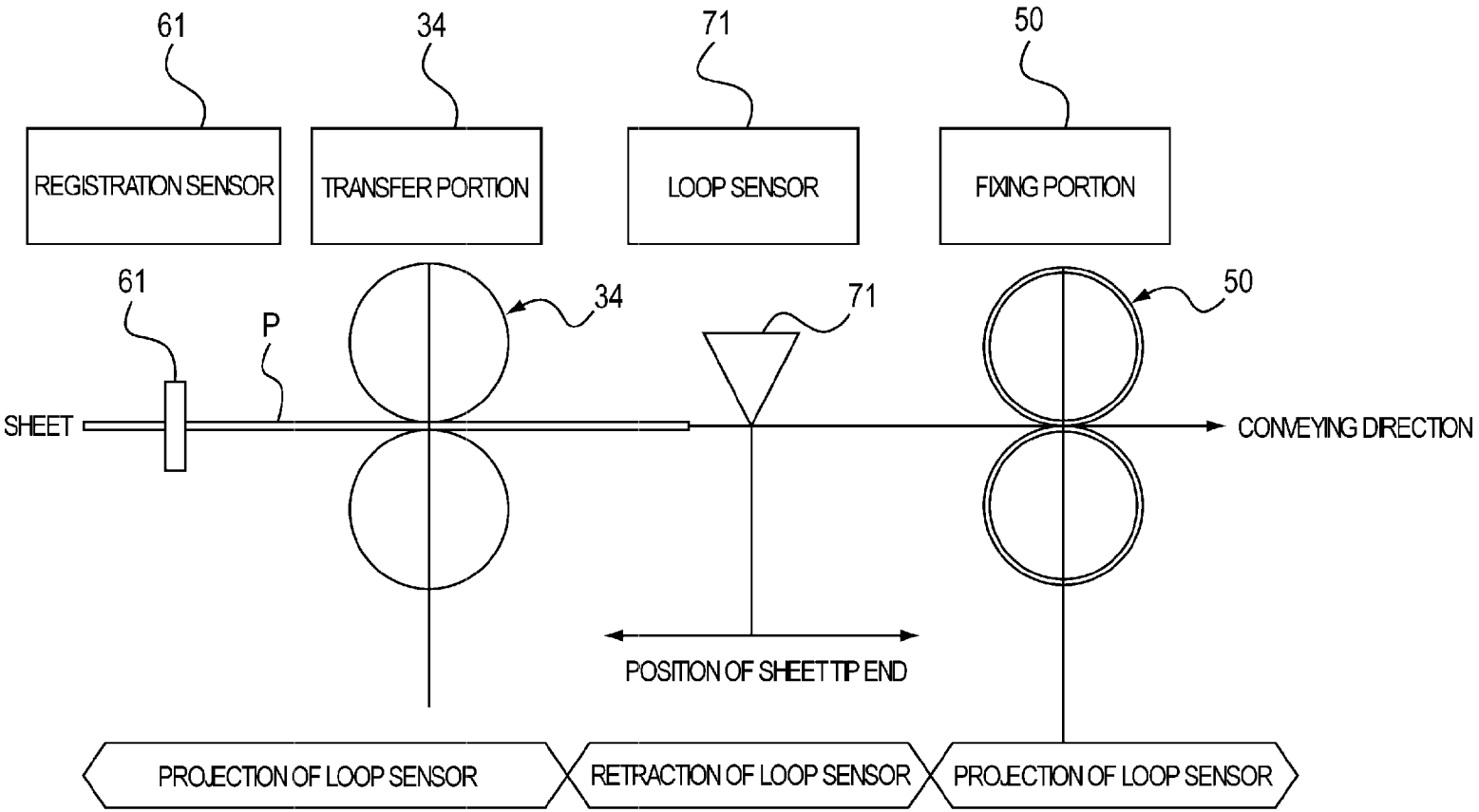
FIG. 7 is a schematic diagram illustrating projecting/retracting timing of a loop sensor in a modification.

In this embodiment, the timing of retracting the loop detection flag 71 from the sheet conveying path 60 is set to the timing when a sheet tip end reaches the transfer apparatus 34. However, it is also possible to perform control such that the contact portion 71*a* is retracted only before and after the sheet tip end passes through the position of the loop detection flag 71 as illustrated in FIG. 7. In this case also, the same effect can be obtained.

[Second Embodiment]

A second embodiment of the present invention will be described with reference to FIG. 8. A configuration and an image forming operation of an image forming apparatus of the second embodiment are the same as those of the color image forming apparatus 42 of the first embodiment. Members having the same functions as those of the color image forming apparatus 42 described in the first embodiment are designated with the same symbols, and description thereof will not be repeated. Portions of the image forming apparatus which are different from those of the color image forming apparatus 42 described in the first embodiment will be described mainly.

When sheets are continuously fed, i.e., when a precedent sheet P1 which has entered the sheet conveying path 60 passes through the contact portion 71*a* in the retracted position, if there is a subsequent sheet P2 which enters the sheet conveying path 60, the controlling portion 40 of this embodiment carries out the following control. That is, the controlling portion 40 controls the solenoid 80 such that before a tip end of the precedent sheet P1 which has passed the contact portion 71*a* reaches the fixing unit 50, the contact portion 71*a* is moved to the projecting position. Further, the controlling portion 40 controls the solenoid 80 such that before a tip end of the subsequent sheet P2 reaches the contact portion 71*a*, the contact portion 71*a* is moved from the projecting position to the retracted position.

That is, when sheets are continuously fed, in the feeding operation of second and subsequent sheets, the loop detection flag 71 is retracted when the loop control of a sheet which has been just fed is completed. More specifically, the contact portion 71*a* is retracted when a rear end of the precedent sheet P1 passes through the loop detection flag 71.

Figure 8:
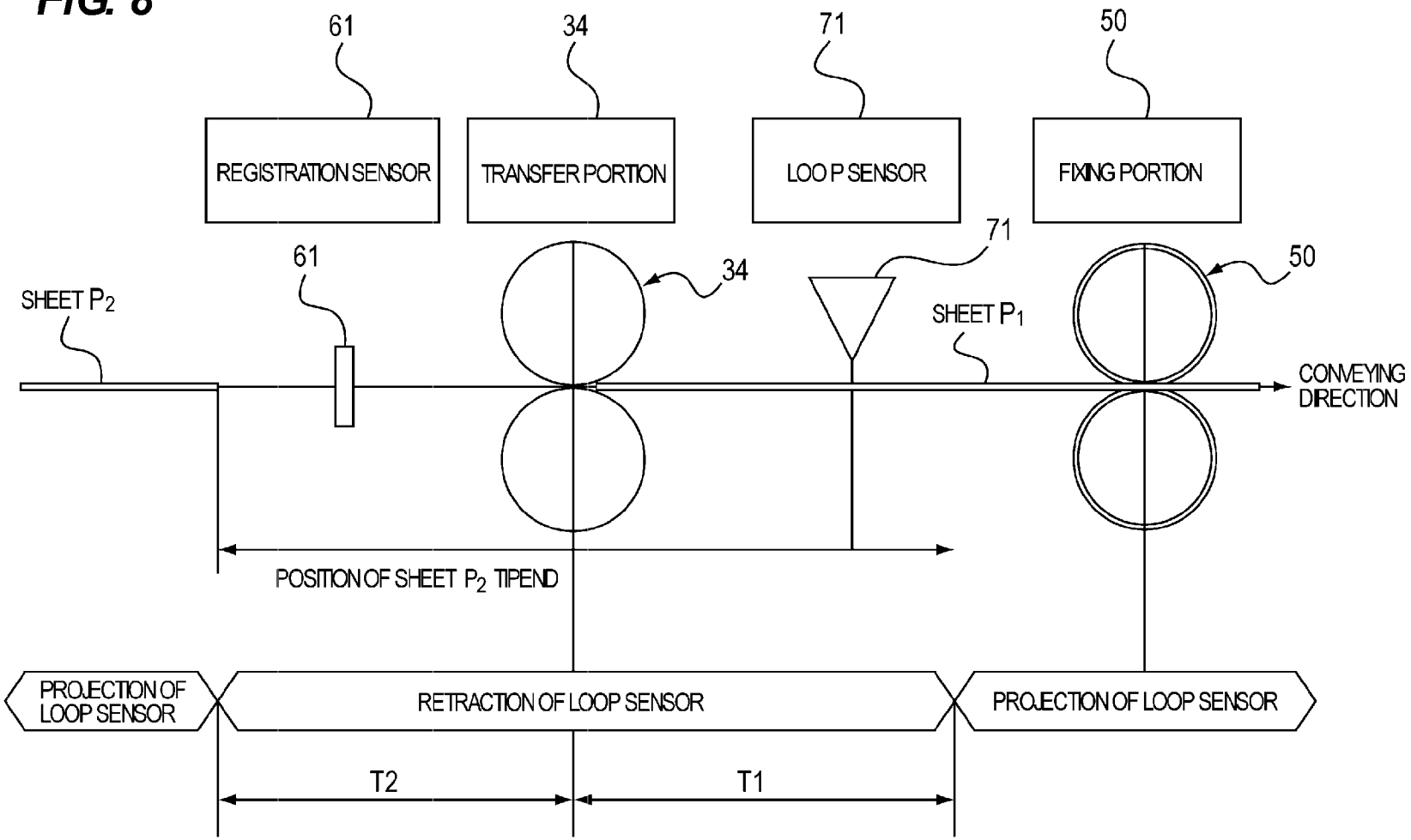
FIG. 8 is a schematic diagram illustrating projecting/retracting timing of a loop sensor in a second embodiment.

FIG. 8 illustrates this state. In the first embodiment, timing when the loop detection flag 71 is retracted is only time T1 which is elapsed until a sheet tip end passes through the position of the loop detection flag 71 after the sheet tip end passes through the transfer apparatus 34. The second embodiment is different from the first embodiment in that time T2 which is elapsed until a tip end of a sheet P2 reaches the transfer apparatus 34 after a rear end of a precedent sheet P1 which was just fed passes through the transfer apparatus 34 is added to the time T1. In the feeding operation of the first sheet, the loop detection flag 71 may be retracted from any timing only if this timing is before a sheet reaches.

According to this configuration, the loop detection flag 71 can be retracted well in advance even when a conveying velocity of a sheet is fast or a distance from the transfer apparatus 34 to the loop detection flag 71 is short, and it is possible to reliably control a loop.

Since the loop detection flag 71 is retracted when a rear end of a sheet passes through the transfer apparatus 34, generation of a paper wrinkle can be prevented. The paper wrinkle is generated when the sheet passes through the transfer apparatus 34, and the paper wrinkle is prone to be generated at a rear end as compared with the sheet tip end. This is because that the sheet is excessively heated by the fixing unit 50 and heat shrunk, a kink generated by the shrink grows and becomes a paper wrinkle. At that time, if the loop detection flag 71 is in contact with the sheet, the contact portion is pushed, kinks gather, and generation or growth of paper wrinkle is promoted in some cases. Since the loop control is not required after the rear end of the sheet passes through the transfer apparatus 34, if the loop detection flag 71 is retracted from the sheet conveying path 60 at this timing, it is possible to avoid a case where kinks of the sheet gather at one location and grow and become the paper wrinkle.

A result of check of a harmful influence of an image when this embodiment is used and when a comparative example is used is shown below. In a first comparative example, the loop detection flag 71 is not retracted at both a tip end and a rear end of a sheet. In a second comparative example, the loop detection flag 71 is retracted only at the sheet tip end. Like the Table 1, sheets of paper having three kinds of basis weights of 75 g/m2, 60 g/m2 and 52 g/m2 are prepared, 1000 sheets of each kinds are fed, and generation ratios of paper wrinkle and paper jam generated at rear ends of the sheets are compared. If a sheet includes much moisture, its elasticity becomes weak, and a kink is prone to be generated, so that the generation ratio of paper wrinkle is increased. Therefore, this experiment was carried out under environment of high temperature and high humidity of 30° C. and 80%. Table 2 shows the generation ratio of paper wrinkle at a position of a rear end of a sheet.

TABLE 2

| | Sheet basis weight (g/m2) | | |
|---|---|---|---|
| | 75 | 60 | 52 |
| Comparative example 1 | Δ | Δ | x |
| Comparative example 2 | ○ | ○ | Δ (*) |
| Second embodiment | ○ | ○ | ○ |

○: Less than 1%
Δ: Generation ratio is less than 3%
x: Generation ratio is 3% or more
(*): Sufficiently permissible level From a result shown in Table 2, it is found that in the first comparative example, as the basis weight of sheets becomes smaller, the generation ratio of paper wrinkle is increased at the position of the rear end of the sheet, but in the embodiment, since the loop detection flag 71 is retracted at the rear end of the sheet, the generation ratio of paper wrinkle at the rear end of the sheet is reduced. In the second comparative example, in a thin paper sheet having a basis weight of 52 g/m2, paper wrinkle of Δ (*) level was generated, but in the embodiment, since the loop detection flag 71 is retracted at the rear end of the sheet, generation of paper wrinkle of this level could be suppressed. However, (*) in the second comparative example shows that the level of generated paper wrinkle was extremely low as compared with the first comparative example, and the paper wrinkle was sufficiently permissible.

The loop control of sheets between the transfer apparatus 34 and the fixing unit 50 is described in the first and second embodiments, but the invention is not limited to this, and the loop control between the registration roller 29 and the transfer apparatus 34 can also be applied in the same manner. In this case, the upstream conveying portion is constituted by the registration roller 29 as a conveying apparatus which conveys a sheet P fed from the sheet feeding apparatus to the transfer apparatus 34. The downstream conveying portion is constituted by the transfer apparatus 34 which conveys a toner image born by the intermediate transfer belt 30 while transferring the toner image to the sheet P conveyed by the registration roller 29. Also in this case, the same effect as that when the upstream conveying portion is the transfer apparatus 34 and the downstream conveying portion is the fixing unit 50 can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-290292, filed Dec. 22, 2009, which is hereby incorporated by reference herein in its entirety.

What is claimed is:

1. An image forming apparatus comprising:

an upstream conveying portion which conveys a sheet;

a downstream conveying portion which is disposed downstream of the upstream conveying portion and which conveys the sheet conveyed by the upstream conveying portion; wherein a loop is formed in the sheet between the upstream conveying portion and the downstream conveying portion by a difference of a sheet conveying velocity of the upstream conveying portion and a sheet conveying velocity of the downstream conveying portion while conveying the sheet with the upstream conveying portion and the downstream conveying portion; and a loop detector which brings a contact portion into contact with the sheet which is conveyed on a sheet conveying path between the upstream conveying portion and the downstream conveying portion, wherein at least one of the sheet conveying velocity of the upstream conveying portion and the sheet conveying velocity of the downstream conveying portion is controlled based on a detection signal of the loop detector, and the sheet is conveyed while maintaining a loop amount of the loop within a predetermined range, and a driving portion which moves the contact portion to a projecting position where the contact portion is in contact with a conveyed sheet and to a retracted position where the contact portion is not in contact with the conveyed sheet on the sheet conveying path; and a controlling portion which controls the driving portion such that the contact portion is moved from the projecting position to the retracted position before a leading edge of a sheet in a sheet conveying direction which enters the sheet conveying path reaches a position on the sheet conveying path that corresponds to the contact portion and the contact portion is moved to the projecting position from the retracted position before the leading edge of the sheet which has passed through the position corresponding to the contact portion reaches the downstream conveying portion.

2. The image forming apparatus according to claim 1, wherein the controlling portion controls the driving portion such that the contact portion is moved from the projecting position to the retracted position before a leading edge of a subsequent sheet reaches the contact portion.

3. The image forming apparatus according to claim 1, further comprising an image forming portion, and an image bearing member which bears a toner image formed by the image forming portion, wherein the upstream conveying portion is a transfer apparatus which conveys a sheet while transferring a toner image born by the image bearing member to the sheet, and the downstream conveying portion is a fixing apparatus which conveys the sheet while fixing the toner image transferred to the sheet by the transfer apparatus.

4. The image forming apparatus according to claim 1, further comprising an image forming portion, an image bearing member which bears a toner image formed by the image forming portion, and a sheet feeding apparatus which feeds a sheet to the upstream conveying portion, wherein the upstream conveying portion is a conveying apparatus which conveys a sheet fed from the sheet feeding apparatus to the downstream conveying portion, and the downstream conveying portion is a transfer apparatus which conveys a sheet while transferring a toner image born by the image bearing member to a sheet conveyed by the conveying apparatus.

5. The image forming apparatus according to claim 1, wherein the controlling portion controls the driving portion such that the contact portion is moved from the projecting position to the retracted position when the leading edge of the sheet reaches the upstream conveying portion.

6. The image forming apparatus according to claim 1, wherein the controlling portion controls the driving portion such that the contact portion is moved from the projecting position to the retracted position when the leading edge of the sheet reaches a position between the upstream conveying portion and the position corresponding to the contact portion.

7. The image forming apparatus according to claim 1, wherein the controlling portion controls the driving portion such that the contact portion is moved from the projecting position to the retracted position before the leading edge of the sheet reaches the upstream conveying portion.

8. The image forming apparatus according to claim 1, wherein when the contact portion is moved to the projecting position from the retracted position before the leading edge of the sheet reaches the downstream conveying portion, the controlling portion controls a sheet conveying speed of the downstream conveying portion based on a signal from the loop detector.

9. The image forming apparatus according to claim 8, wherein in a case that a sensor of the loop detector is OFF, the controlling portion controls the sheet conveying speed of the downstream conveying portion to decrease speed and in a case that the sensor of the loop detector is ON, the controlling portion controls the sheet conveying speed of the downstream conveying portion to increase speed.

* * * * *